US010830559B2

(12) United States Patent
Rothärmel et al.

(10) Patent No.: US 10,830,559 B2
(45) Date of Patent: Nov. 10, 2020

(54) DEVICE FOR POSITIONING A STOCK PORTION ON A GUNSTOCK AND GUNSTOCK COMPRISING SUCH A DEVICE

(71) Applicant: Blaser Group GmbH, Isny (DE)

(72) Inventors: Jürgen Rothärmel, Isny (DE); Martin Vetter, Ulm (DE); Bastian Fink, Immenstadt (DE); Peter Wiedemann, Scheuring (DE)

(73) Assignee: Blaser Group GmbH, Isny (DE)

( * ) Notice: Subject to any disclaimer, the term of this patent is extended or adjusted under 35 U.S.C. 154(b) by 0 days.

(21) Appl. No.: 16/745,593

(22) Filed: Jan. 17, 2020

(65) Prior Publication Data

US 2020/0232752 A1 Jul. 23, 2020

(30) Foreign Application Priority Data

Jan. 17, 2019 (DE) ..... 10 2019 101 228

(51) Int. Cl.
*F41C 23/14* (2006.01)
*F41C 23/20* (2006.01)

(52) U.S. Cl.
CPC ..... *F41C 23/14* (2013.01); *F41C 23/20* (2013.01)

(58) Field of Classification Search
CPC ..... F41C 23/14; F41C 23/12; F41C 23/20; F41C 23/08; F41C 23/00; F41C 23/06
See application file for complete search history.

(56) References Cited

U.S. PATENT DOCUMENTS

| | | | | |
|---|---|---|---|---|
| 3,137,958 | A | 6/1964 | Lewis et al. | |
| 7,984,580 | B1 * | 7/2011 | Giauque | F41C 23/14 42/73 |
| 10,060,699 | B1 * | 8/2018 | Hu | F41C 23/04 |
| 10,591,246 | B2 * | 3/2020 | Lundback | F41C 23/14 |
| 2002/0059747 | A1 * | 5/2002 | Weldle | F41C 23/14 42/72 |
| 2011/0283584 | A1 | 11/2011 | Walters | |
| 2017/0241737 | A1 * | 8/2017 | Keller, II | F41C 23/20 |
| 2018/0120055 | A1 | 5/2018 | Silverman et al. | |
| 2019/0204044 | A1 | 7/2019 | Overstreet et al. | |

FOREIGN PATENT DOCUMENTS

| | | |
|---|---|---|
| DE | 10 2004 057415 A1 | 6/2005 |
| DE | 10 2004 027123 B3 | 8/2005 |

* cited by examiner

*Primary Examiner* — Stephen Johnson
(74) *Attorney, Agent, or Firm* — Paul D. Bianco; Gary S. Winer; Fleit Intellectual Property Law

(57) ABSTRACT

A device for positioning a stock member on a gunstock includes at least one guide element which is disposed on the stock member and movably guided in a receiving member, and a positioning mechanism which comprises at least one retaining member dedicated to the guide member and an operating member for moving the retaining member between a retaining position for locking the guide member into position and a release position for changing the position of the guide member. To provide for an easily adjustable limit stop position of the stock member, a position-adjustable stop member for limiting the extending movement of the guide member is dedicated to the one or more guide members.

15 Claims, 6 Drawing Sheets

DEVICE FOR POSITIONING A STOCK PORTION ON A GUNSTOCK AND GUNSTOCK COMPRISING SUCH A DEVICE

FIELD OF THE DISCLOSURE

The present disclosure relates to a device for positioning a stock member on a gunstock. The present disclosure further relates to a gunstock comprising such a device.

BACKGROUND

U.S. Pat. No. 3,137,958 discloses a gunstock with an adjustable stock cap. The stock cap is movably guided via two parallel guide rods in complementary guide openings on the back of a gunstock. Disposed on the outside surface of the two guide rods are a plurality of detent notches separated by a distance from each other for engaging in wedge-shaped detent members on a spring-actuated detent rod. By pushing the detent rod against the force of the compression spring, the detent rod which is locked in the detent notches can be released to allow the stock cap to be repositioned. Disposed at the free ends of the two guide rods is a stepped shoulder, which, in combination with the wedge-shaped detent members on the detent rod, defines an extended end position of the stock cap. However, because of the wedge-shaped detent members on the detent rod, the stock cap can be pulled out beyond the end position when a sufficiently high force is exerted. Furthermore, the end position cannot be changed.

SUMMARY

One aspect of the disclosure relates to a device for positioning a stock member on a gunstock and a gunstock comprising such a device, which allow an easily adjustable limit stop position of the stock member.

Useful embodiments and advantageous refinements are also disclosed.

The device according to the present disclosure for positioning a stock member on a gunstock comprises at least one guide member, which is disposed on the stock member and which is movably guided in a receiving member, and a positioning mechanism, which comprises at least one retaining member dedicated to the guide member and an operating member for moving the retaining member between a retaining position for locking the guide member into position and a release position for repositioning the guide member. To limit the extending movement of the guide member, a stop member, the position of which can be changed, is dedicated to the one or more guide members. Because the position of the stop member can be changed, the extended position can be set to a desired dimension and easily changed, as needed. Thus, the stock member can be retracted, e.g., for transporting the firearm, and easily and safely returned to the previously set extended position.

According to a particularly expedient embodiment, the stop member can be moved into a release position for changing the position of the stop member by means of the operating member provided for moving the one or more retaining members. Thus, the position of the stock member can be set and the position of the stop member changed with a single operating member.

According to an especially advantageous embodiment, the stop member can be pushed into a locking position on the one or more guide members through use of a spring-loaded push mechanism.

The positioning mechanism preferably comprises a securing device which allows the position of the stop member to be changed only when the stop member abuts the receiving member. Thus, the position of the stop member can be changed only when the stock member is in a predetermined position, e.g., in a fully extended position.

To ensure that the adjustable stock member is especially stably guided, two parallel guide members, which are movably guided in guide openings of the receiving member, are disposed on the stock member. However, it is also possible to use only one guide member. The guide member is preferably designed in the form of a rod or column. However, other shapes are possible as well.

The operating member can preferably be moved between a starting position for locking the one or more guide members in position, a release position for repositioning the one or more guide members, and a set position for setting the stop member. The operating member can be pushed into the starting position by means of two springs, each having a different spring stiffness, and can be configured in the form of, e.g., a push mechanism or a folding lever.

To ensure that the guide members are especially securely locked into a desired position, the retaining member is designed to form-fittingly engage in the one or more guide members. The retaining member can have, e.g., a serrated edge for engaging in detent notches on the guide member.

To securely retain the stop member on the guide member, the stop member can have a locking edge for form-fittingly engaging in the one or more guide members. The locking edge can engage, e.g., in the detent notches or slots on the guide member.

The guide member can be biased by a compression spring and can be pushed in the extension direction. This allows the stock member to automatically extend when the locking mechanism is released.

According to a possible embodiment, the positioning mechanism can comprise two block-shaped retaining members adjustable in opposing directions for engaging in two parallel guide members. However, the positioning mechanism can also have a plate-shaped retaining member that can pivot about a guide rod.

The present disclosure further relates to a gunstock which comprises an above-described device for positioning a stock cap and/or a stock comb.

BRIEF DESCRIPTION OF THE DRAWINGS

Additional characteristic features and advantages of the disclosure follow from the description of preferred embodiment examples below with reference to the drawing. In the drawing.

DETAILED DESCRIPTION

Figure 1:
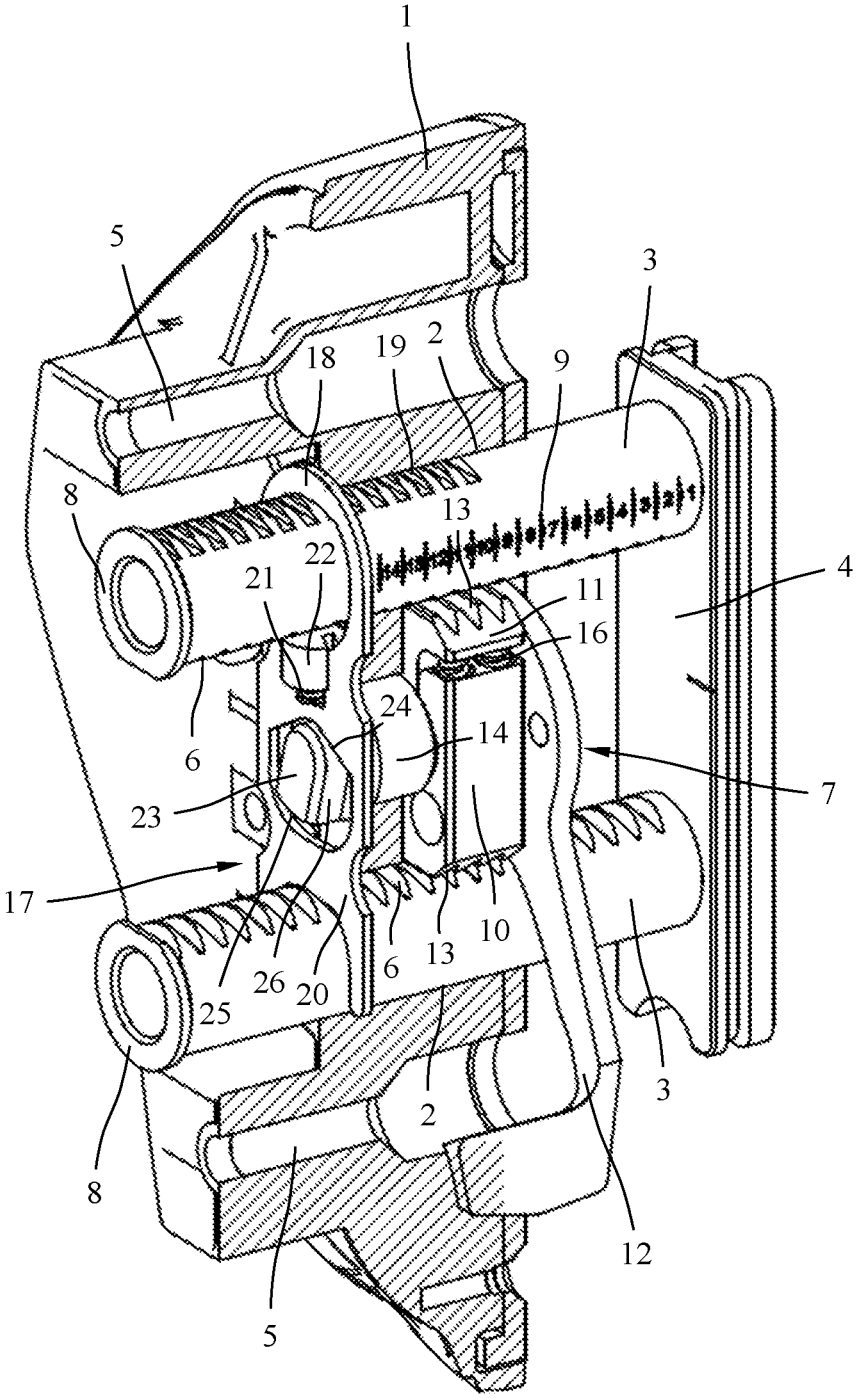
FIG. 1 shows a first sectional view of a first embodiment example of a device for positioning a stock member.

FIGS. 1 to 4 show different views of a first embodiment example of a device for positioning a stock member on a gunstock. This embodiment example is designed for positioning a stock cap and shows a receiving member 1, which can be attached to the back of a gunstock, with two parallel guide openings 2 for movably guiding two rod- or column-shaped guide members 3. Attached to the outside ends of the two guide members 3, which protrude rearwardly relative to the receiving member 1, is a plate-shaped stock member 4 for releasably retaining a stock cap (not shown in the drawing). It is also possible for the two guide members 3 to be disposed directly on a stock cap. The receiving member 1 is designed as an insert for mounting in a corresponding opening at the rearward end of a gunstock and has continuous receiving openings 5 for fastening screws for releasably retaining the receiving member 1 on the gunstock above and below the guide openings 2.

A plurality of detent notches 6 separated by a distance from each other in the axial direction for engaging in a positioning mechanism 7 (explained in greater detail below) are disposed on the outside surface of the guide members 3, which are movably guided inside the hole-shaped guide openings 2 of the receiving member 1. In the embodiment shown, the detent notches 6 are disposed on the bottom surface of the upper guide member 3 and on the top surface of the lower guide member 3. On the inside ends disposed inside the receiving member 1, the two rod- or column-shaped guide members 3 have an annular collar 8 with an expanded diameter, which serves as a limit stop. In addition, an indicator 9 for indicating the extended and/or retracted position of the stock member 4 is provided on the outside surface of one of the two rod- or column-shaped guide members 3.

The positioning mechanism 7 disposed inside the receiving member 1 comprises two block-shaped retaining members 10 and 11, adjustable in opposing directions, which can be moved between a pushed-together release position and a pushed-apart retaining position via a drive mechanism actuated by means of an operating member 12. On the outside surfaces facing the guide members 3, the two retaining members 10 and 11, which are disposed between the guide members 3, have a serrated edge 13 for engaging in the detent notches 6 of the guide members 3.

Figure 2:
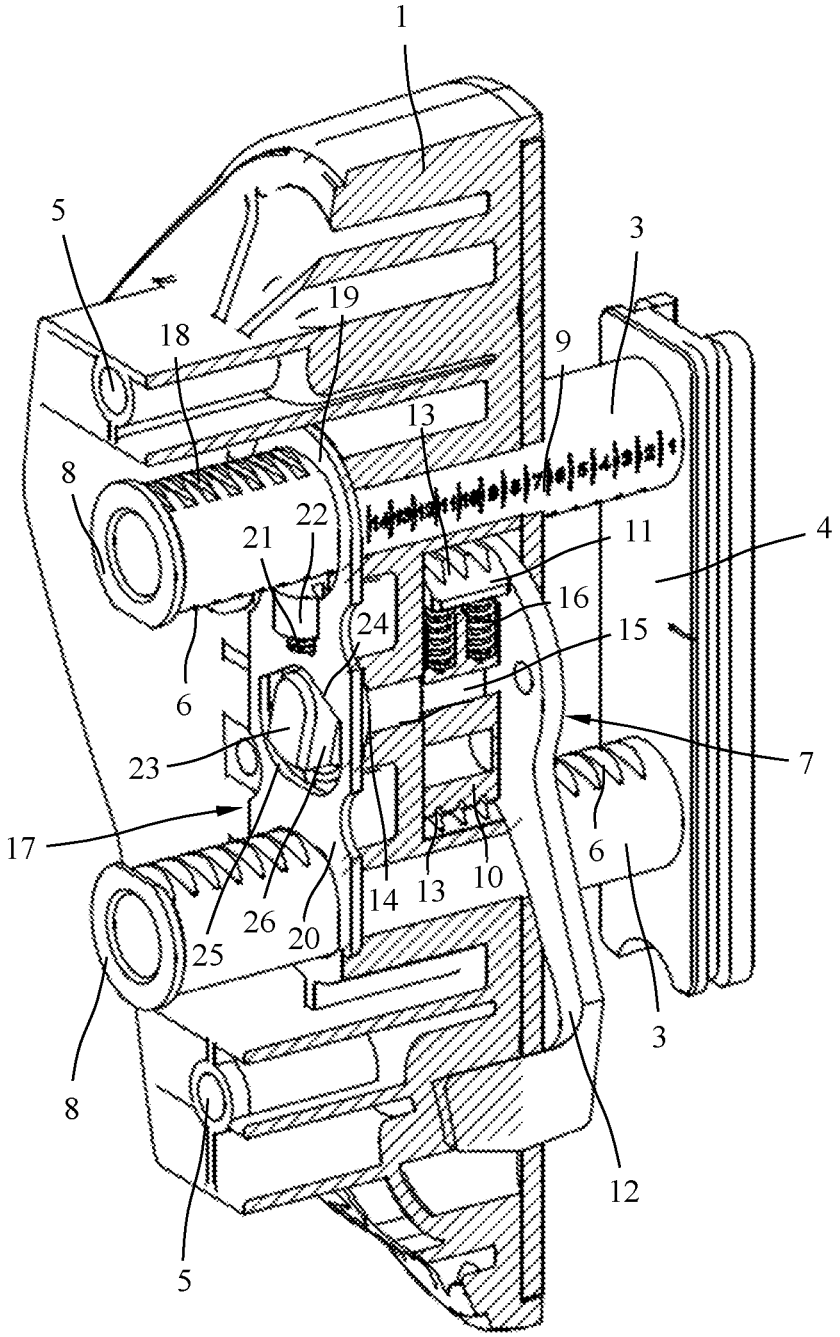
FIG. 2 shows a second sectional view of the device shown in FIG. 1 for positioning a stock member.
Figure 3:
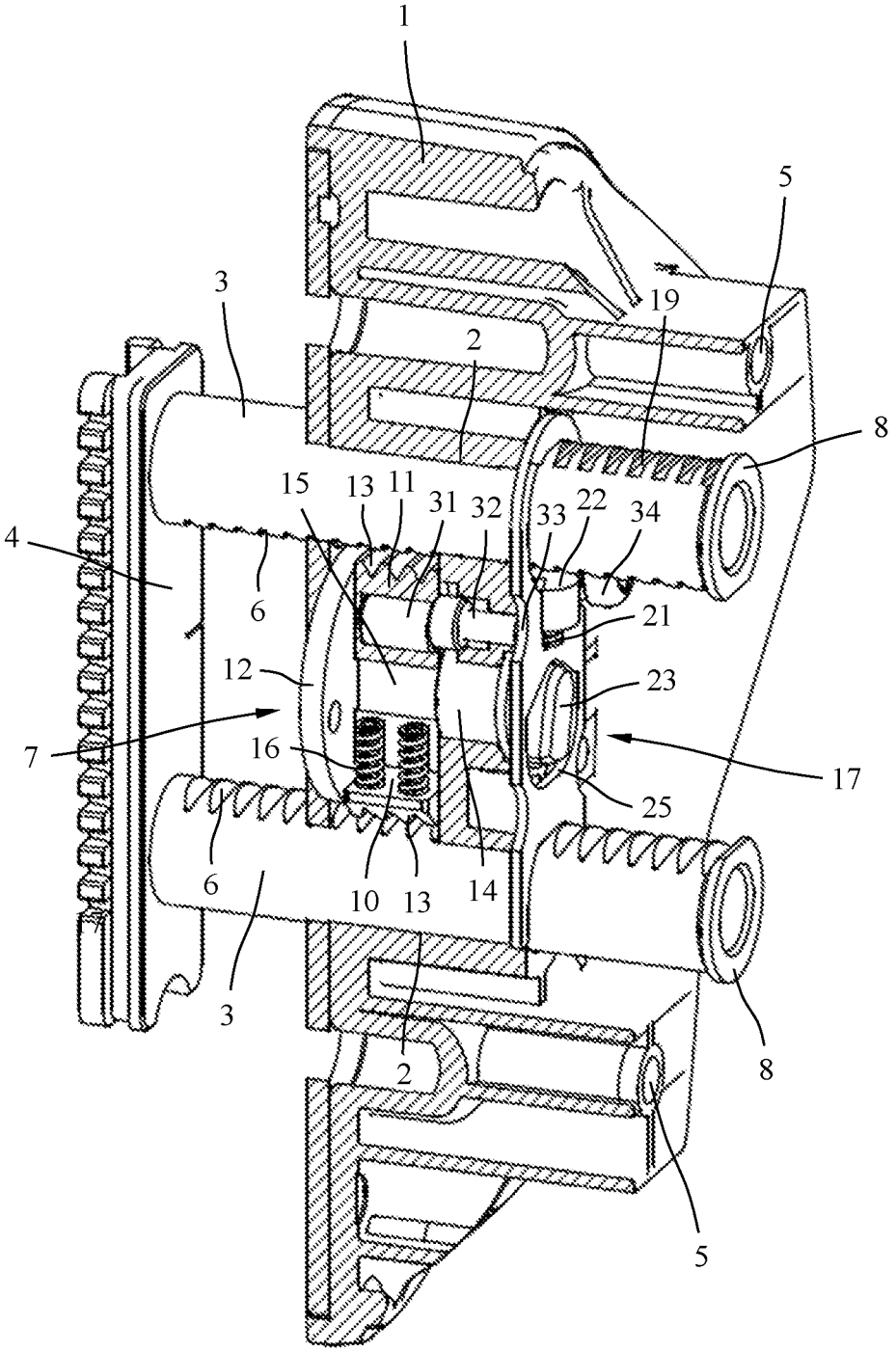
FIG. 3 shows a third sectional view of the device shown in FIG. 1 for positioning a stock member.

As especially clearly indicated in FIGS. 2 and 3, the drive mechanism for positioning the two retaining members 10 and 11 contains a drive member 14, which can be rotated by the operating member 12 and which has a control member 15 that is arranged between and interacts with the two retaining members 10 and 11 and that by rotating moves the two retaining members 10 and 11 away from or toward each other. The two retaining members 10 and 11 are spring-biased toward the outside into the retaining position by means of compression springs 16 clamped therebetween. In the embodiment shown, the operating member 12 is configured in the form of a folding lever which can be moved between a lower starting position, a center release position and an upper setting position. The operating member 12 in the form of a folding lever is connected to the drive member 14, which is rotatably disposed in the receiving member 1, in such a manner that the two retaining members 10 and 11 are moved by the control member 15 from the pushed-apart retaining position into the pushed-together release position whenever the operating member 12 in the form of a folding lever is turned from the lower starting position upwardly into a predetermined release position.

In addition, releasably attached to one of the two guide members 3 is a stop member 17 for limiting the extending movement of the guide members 3, the position of which stop member can be adjusted. In the embodiment shown, an annular upper portion 18 of the plate-shaped stop member 17 engages in slots 19 on the top surface of the upper rod-shaped guide member 3. A fork-shaped lower portion 20 movably guides the plate-shaped stop member 17 along the lower guide member 3.

A push mechanism 22, which is biased by a compression spring 21 and which is movably disposed in the plate-shaped stop member 17, pushes the stop member 17 downwardly so that the annular upper portion 18 of the stop member 17 engages in one of the slots 19 of the upper guide member 3, and the fork-shaped lower portion 20 engages in one of the detent notches 6 on the lower guide member 3, thereby retaining the stop member 17 in a specific locking position on the guide members 3. When the lever-shaped operating member 12 is turned upwardly from the starting position into the release position, thereby releasing the locking mechanism by moving the two retaining members 10 and 11 toward each other, the stock member 4 can be manually pulled out until the stop member 17 comes to abut the receiving member 1.

To change the position of the stop member 17, the stop member must be pushed upwardly against the force of the push mechanism 22, which is actuated by the compression spring 21. This is implemented by a control cam 23, which is disposed on the inner end surface of the drive member 14 and is designed to engage in an opening 25 of the stop member 17, said opening having a control surface 24, and which has a lateral abutment surface 26 for contacting the control surface 24 of the stop member 17. To change the position of the stop member 17, the stock member 4 must first be pulled out into the fully extended limit stop position, so that the control cam 23 disposed on the inside end of the drive member 14 engages in the opening 25 of the stop member 17. To this end, the operating member 12 must first be turned upwardly from the lower starting position into the release position, so that the two retaining members 10 and 11 are moved into the release position.

Figure 4:
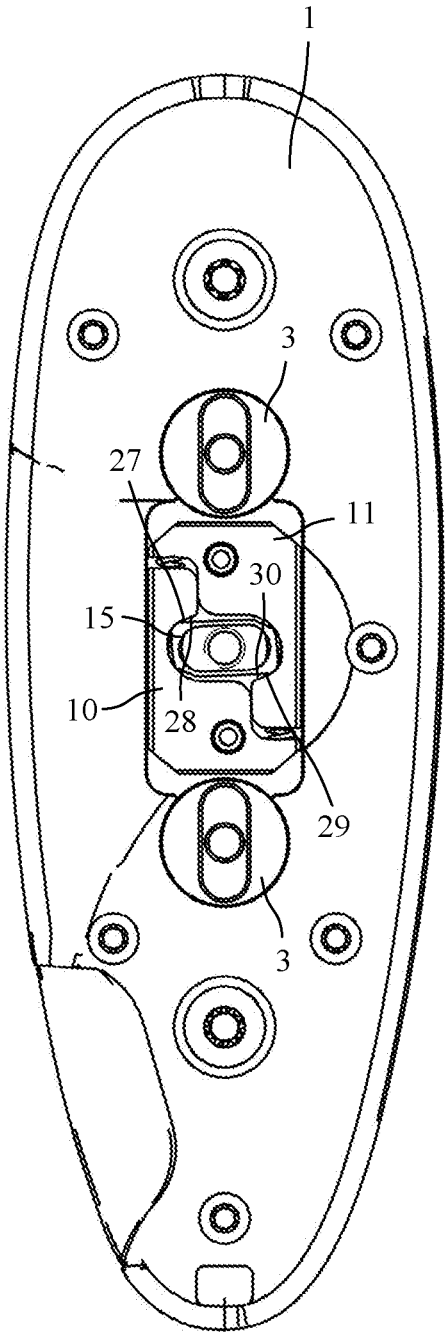
FIG. 4 shows a cross section through the device shown in FIG. 1 in the area of a control member between two retaining members.

As the cross section (shown in FIG. 4) through the receiving member 1 in the area of the control member 15 indicates, the control member 15 of the drive member 14, which control member is disposed between the retaining members 10 and 11, is configured in the form of a transverse piece with an upper abutment surface 27 for abutting a downwardly facing mating surface 28 of the lower retaining member 10 and a lower abutment surface 29 for abutting an upwardly facing mating surface 30 of the upper retaining member 11. Thus, as the operating member 12 is turned into the release position, the lower retaining member 10, as shown in FIG. 4, is pushed upwardly by the upper abutment surface 27, and the upper retaining member 11 is pushed downwardly by the lower abutment surface 29. As a result, the locking mechanism of the two rod-shaped guide members 3 can be released, and the two guide members 3 can be pulled out rearwardly with the stock member 4.

As indicated in FIG. 3, a locking pin 31, which moves parallel to the guide members 3, is disposed in the upper retaining member 11. Inside the upper retaining member 11, the spring-actuated locking pin 31 can be moved between a pushed-in release position and an extended locking position. In the extended locking position of the locking pin 31, the locking pin limits the downward movement of the upper retaining member 11 and thus the turning movement of the operating member 12. The locking pin 31 can be moved by the stop member 17 via a signal pin 32 which is movably guided inside the receiving member 1. The locking pin 31 is moved via the signal pin 32 into the pushed-in release position only if the stop member 17 comes to abut the receiving member 1. Only in this position is it possible for the operating member 12 to be turned further upwardly beyond the center release position into the upper set position for repositioning the stop member 17. If the signal pin 32 instead protrudes relative to the receiving member 1 and is not pushed in by the stop member 17, the locking pin 31 is also pushed into the extended locking position by a spring, so that the downward movement of the upper retaining member 11 is limited, and the operating member 12 can be moved only up to the upper release position. This ensures that the position of the stop member 17 can be changed only in the fully extended position of the stock member 4.

If the stock member 4 is pulled out until it abuts the stop member 17 on the receiving member 1 and the locking pin 31 is pushed in by the stop member 17 via the signal pin 32, the operating member 12 can be turned further upwardly, beyond the center release position. This causes the abutment surface 26 (shown in FIG. 2) of the control cam 23 engaged in the opening 25 of the stop member 17 to abut the control surface 24, which in turn causes the stop member 17 to be lifted against the compressive force of the push mechanism 21 actuated by the compression spring 22. The stop member 17 is moved in such a way that the area thereof below two lateral slots 33 shown in FIG. 3 comes to be positioned behind the heads of two screws 34 that are screwed into the receiving member 1, thereby securing it against movement. Subsequently, the stock member 4 can be manually set to a new limit stop position desired. By releasing the lever-shaped operating member 12, the stop member 17 is locked into the desired position of the guide member 3 and is thus repositioned.

Figure 5:
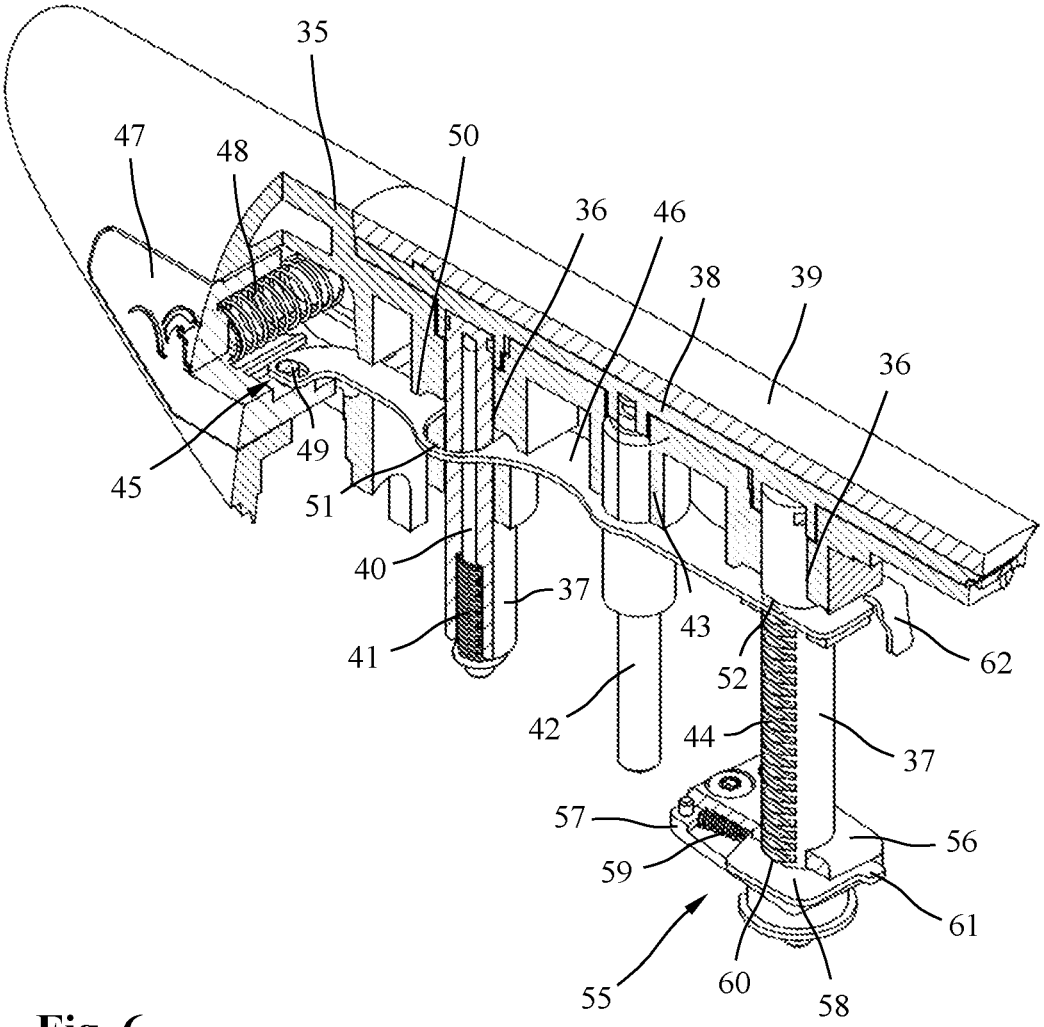
FIG. 5 shows a first sectional view of a second embodiment example of a device for positioning a stock member.

FIG. 5 shows a second embodiment example of a device for positioning a stock member on a gunstock. This device is designed for positioning a stock cheek and again has a receiving member 35 that can be inserted into a gunstock and that has two parallel guide openings 36 for movably guiding two rod- or column-shaped guide members 37. The receiving member 35 shown in this embodiment example is configured for insertion into a complementary opening on the upper surface of a gunstock. In this embodiment, again, a plate-shaped stock member 38 is attached to the outwardly protruding, relative to the receiving member 1, outside ends of the two guide members 3. A stock cheek 39 can be mounted on this height-adjustable stock member 38. In the embodiment example shown, the two rod- or column-shaped guide members 37 are each movably disposed on a guide rod 40 and are each upwardly biased by a compression spring 41, which is clamped between the guide member 37 and the guide rod 40, and pushed into the extended direction.

Attached to the lower surface of the stock member 38 is a center guide rod 42 which is disposed between the two guide members 37. The center guide rod 42 is movably guided in a rod guide 43 disposed between the two guide openings 36 inside the receiving member 35. The outside surface of the guide members 37 has a plurality of detent notches 44 separated by a distance from each other in the axial direction for engaging in a positioning mechanism 45, which will be explained in greater detail below. In the embodiment shown, the detent notches 44 are disposed on the left side of the rear guide member 37 as seen in the downrange direction and on the right side of the front guide member 37 as seen in the downrange direction.

The positioning mechanism 45 comprises a plate-shaped retaining member 46, configured here in the form of a punch-bent part made of sheet metal, which is rotatably mounted about the guide rod 42 and which can be moved by an operating member 47, configured here in the form of a push-button, from a retaining position in which the retaining member is form-fittingly engaged in the detent notches 44 of the guide members 37 into a release position for repositioning the guide members 37. The operating member 47, configured in the form of a push-button, is pushed outwardly by a spring 48 and is connected in an articulated manner by a pin 49 to the plate-shaped retaining member 46. The retaining member 46, which can be rotated about the guide rod 42, is disposed in a corresponding transverse slot 50 of the retaining member 35 and has two through-openings 51 and 52 for the rod- or column-shaped guide members 37.

Figure 6:
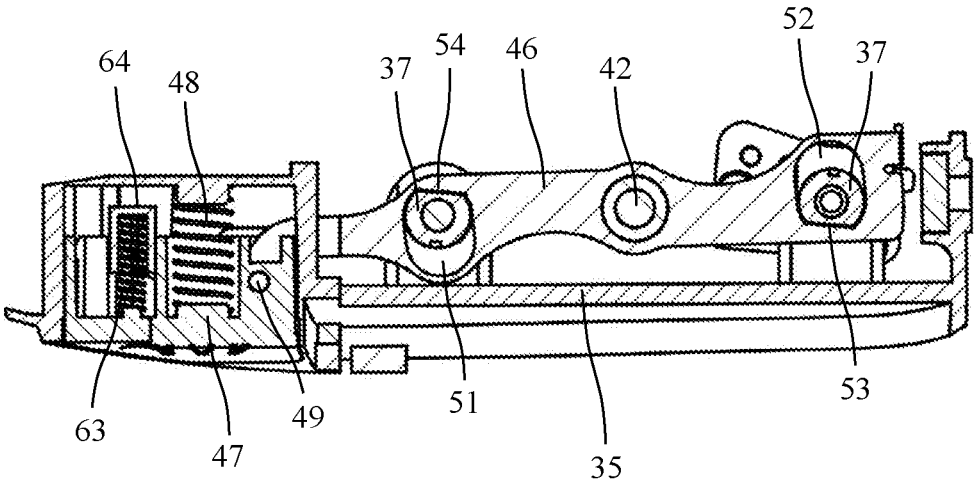
FIG. 6 shows a cross section of the device shown in FIG. 5.

As the cross-sectional view shown in FIG. 6 indicates, the retaining member 46, which can be rotated about the guide rod 42 and which has the two through-openings 51 and 52 for the rod- or column-shaped guide members 37, is designed in such a manner that in the clamping position, a locking edge 53 or 54 disposed on the through-openings 51 and 52 engages in the detent notches 44 (shown in FIG. 5) of the guide members 37, while, when the operating member 47 is pushed in and the retaining member 46 is moved as a result thereof, the locking edges 53 and 54 become disengaged from the detent notches 44 of the guide members 37 and thereby allow the stock member 38 to be repositioned.

Again, in this embodiment example, a stop member 55 (shown in FIG. 5) for limiting the extending movement is disposed on one of the guide members 37. As the guide members 37 are extended, the stop member 55 comes to abut the receiving member 35. In the block-shaped stop member 55, which here consists of two enclosure parts 56 and 57, a plate-shaped push mechanism 58 is rotatably mounted about an axis. This push mechanism 58 which is actuated by a compression spring 59 retains the stop member 55 in the desired position on the guide member 37. In this embodiment, the push mechanism 58 is designed to form-fittingly engage in the guide member 37 and comprises a locking edge 60 for engaging in the detent notches 44 on the guide member 37. The push mechanism 58 has a lug 61 which protrudes relative to the enclosure parts 56 and 57 and which, on abutment of the stop member 55 on the receiving member 35, comes to abut a downwardly bent tab 62 on the end of the plate-shaped retaining member 46.

When the stop member 55 is in the limit stop position on the receiving member 35, the push mechanism 58, by continuing to push the operating member 47 away from the tab 62 on the retaining member 46, can be rotated against the force of the compression spring 59 in such a way that the locking edge 60 becomes disengaged from the detent notch 44 on the guide member 37 and thus causes the stop member 55 to move into a release position. The push mechanism 58 engages in an undercut on the receiving member 35 so that its position relative to the receiving member 35 is fixed. Subsequently, the position of the stop member 55 relative to the guide member 37 can be set. By releasing the operating member 47, the pressure unit 58 is locked into the new position on the guide member 37, and the stop member 55 is repositioned. In this embodiment again, the position of the stop member 55 can be changed only if the stock member 38 has been fully extended up to the point at which the stop member 55 abuts the receiving member 35.

Similarly, in the embodiment example of FIGS. 5 and 6, again, the operating member 47, which is here configured in the form of a push-button, can be moved between an uncompressed starting position for locking the guide member 37 into position, a partially compressed release position for repositioning the guide member 37 and a fully compressed set position for setting the stop member 55. To make the release position and the set position discernible by touch, a second compression spring 63 (shown in FIG. 6) with a different spring constant is disposed next to the compression spring 48 in the operating member 47. Next to the softer compression spring 48, which pushes the operating member 47 into the uncompressed starting position, the stiffer compression spring 63 is clamped between the operating member 47 and a spring compressor 64. The spring compressor 64, which can be moved relative to the operating member 47, limits the travel path of the compression spring 63. Therefore, the operating member 47, which is configured in the form of a push-button, can be easily compressed only until the spring compressor 64 abuts the receiving member 35. Once this position is reached, the retaining member 46 has been pivoted sufficiently far away that the guide members 37 are released and the stock member 38 with the stock cheek 39 can be extended. To fully compress the operating member 47 for repositioning the stop member 55, the operating member 47 must then be pushed against both compression springs 48 and 63.

Figure 7:
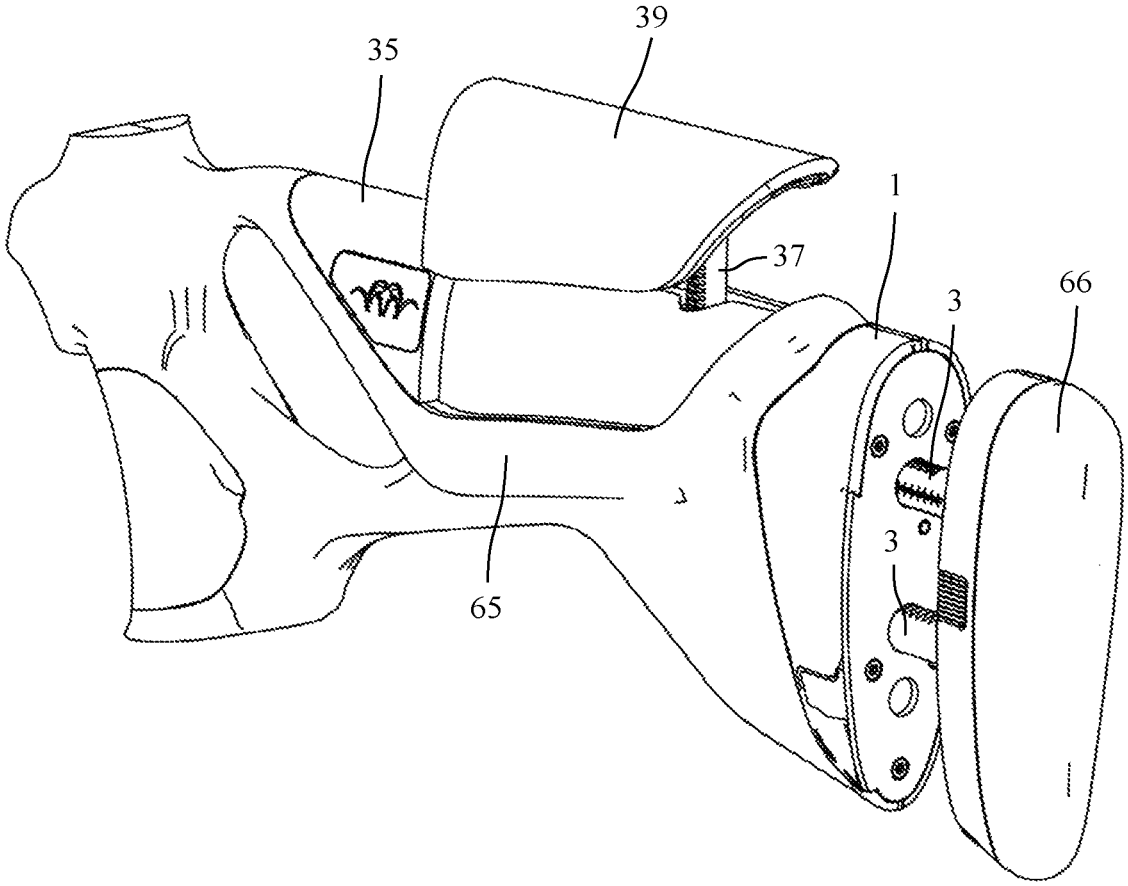
FIG. 7 shows a gunstock with an adjustable stock cap and stock comb.

FIG. 7 shows a gunstock 65 comprising a device (shown in FIGS. 1 to 4) for positioning a stock cap 66 and a device (shown in FIGS. 5 and 6) for positioning the stock cheek 39. The stock cap 66 is releasably attached to stock member 4 shown in FIG. 1.

LIST OF REFERENCE CHARACTERS

1 Receiving member
2 Guide opening
3 Guide member
4 Stock member
5 Receiving opening
6 Detent notch
7 Positioning mechanism
8 Annular collar
9 Indicator
10 Retaining member
11 Retaining member
12 Operating member
13 Serrated edge
14 Drive member
15 Control member
16 Compression spring
17 Stop member
18 Annular upper portion
19 Slot
20 Fork-shaped lower portion
21 Compression spring
22 Push mechanism
23 Control cam
24 Control surface
25 Opening
26 Abutment surface
27 Upper abutment surface
28 Mating surface on the lower retaining member
29 Lower abutment surface
30 Mating surface on the upper retaining member
31 Locking pin
32 Signal pin
33 Slot
34 Screw
35 Receiving member
36 Guide opening
37 Guide member
38 Stock member
39 Stock cheek
40 Guide rod
41 Compression spring
42 Guide rod
43 Rod guide
44 Detent notch
45 Positioning mechanism
46 Retaining member
47 Operating member
48 Spring
49 Pin
50 Transverse slot
51 Through-opening
52 Through-opening
53 Locking edge
54 Locking edge
55 Stop member
56 Enclosure part
57 Enclosure part
58 Push mechanism
59 Compression spring
60 Locking edge
61 Lug
62 Tab
63 Compression spring
64 Spring compressor
65 Gunstock
66 Stock cap

The invention claimed is:

1. A device for positioning a stock member on a gunstock, the device comprising:

at least one guide member disposed on the stock member and movably guided in a receiving member;

a positioning mechanism comprising at least one retaining member removably engageable with the at least one guide member and an operating member for moving the retaining member between a retaining position in which the at least one guide member is retained in a fixed position relative to the receiving member and a release position in which the at least one guide member is movable relative to the receiving member; and a stop member for limiting movement of the at least one guide member, wherein the operating member is movable between a starting position for locking the at least one guide member into position, a release position for changing the position of the at least one guide member and a set position for setting the stop member, and wherein the operating member is pushed into the starting position by two compression springs, each having a different spring stiffness.

2. The device of claim 1, wherein the at least one guide member comprises two parallel guide members movably guided in guide openings of the receiving member.

3. The device of claim 1, wherein the operating member is configured in a form of a folding lever or a push mechanism.

4. The device of claim 1, wherein the at least one retaining member is configured for form-fittingly engaging in the at least one guide member.

5. The device of claim 1, wherein the at least one retaining member comprises a serrated edge or locking edges for engaging in detent notches on the at least one guide member.

6. The device of claim 1, wherein the stop member has a locking edge for form-fittingly engaging in the at least one guide member.

7. The device of claim 1, wherein the at least one guide member is pushed into an extending direction by a biasing compression spring.

8. The device of claim 1, wherein the positioning mechanism comprises a securing device which allows a change in position of the stop member only if the stop member abuts the receiving member.

9. The device of claim 1, wherein the at least one guide member comprises two parallel guide members, wherein the positioning mechanism comprises two block-shaped retaining members for engaging in the two parallel guide members, and wherein the retaining members are adjustable in opposing directions by a drive mechanism.

10. The device of claim 1, wherein the positioning mechanism comprises a plate-shaped retaining member which is rotatable about a guide rod.

11. A gunstock comprising the device of claim 1.

12. The gunstock of claim 11, wherein the stock member is a stock cap or a stock comb.

13. The device of claim 1, wherein the receiving member is mountable on the gunstock and includes an opening for receiving a fastener to removably attach the receiving member to the gunstock.

14. The device of claim 1, wherein the at least one guide member includes indicia for indicating a position of the at least one guide member relative to the receiving member.

15. The device of claim 1, wherein the at least one guide member includes an annular collar.

* * * * *